US005224592A

United States Patent [19]

Jedlitschka et al.

[11] Patent Number: 5,224,592

[45] Date of Patent: Jul. 6, 1993

[54] HIGH VOLTAGE SWITCH DEVICE AND HIGH-VOLTAGE CHANGE-OVER SWITCH

[75] Inventors: Hans Jedlitschka, Chatillon; Jacques Sireul, Wissous, both of France

[73] Assignee: General Electric CGR S.A., Issy les Moulineaux, France

[21] Appl. No.: 832,477

[22] Filed: Feb. 7, 1992

[30] Foreign Application Priority Data

Feb. 8, 1991 [FR] France ..... 91 01442

[51] Int. Cl.[5] ..... H01H 15/06

[52] U.S. Cl. ..... 200/572; 200/568; 200/149 R; 200/149 B; 200/561; 74/110; 74/471 R

[58] Field of Search ..... 200/572, 568, 561, 10, 200/48 P, 244, 144 A, 144 R, DIG. 4, 149 R, 149 B; 74/110, 471 R

[56] References Cited

U.S. PATENT DOCUMENTS

| | | | |
|---|---|---|---|
| 2,714,144 | 7/1955 | Amundson | 200/146 |
| 3,140,374 | 7/1964 | Cole | 200/149 R |
| 3,235,696 | 2/1966 | Mikulecky | 200/149 R |
| 3,626,126 | 12/1971 | Pesch | 200/149 R |
| 4,755,754 | 7/1988 | Sireul et al. | 324/318 |
| 4,923,295 | 5/1990 | Sireul et al. | 350/639 |
| 4,944,501 | 7/1990 | Sireul et al. | 269/322 |
| 5,003,452 | 3/1991 | Sireul et al. | 363/61 |
| 5,060,253 | 10/1991 | Jedlitschka et al. | 378/101 |

FOREIGN PATENT DOCUMENTS

| | | | |
|---|---|---|---|
| 756019 | 3/1953 | Fed. Rep. of Germany . | |
| 126781 | 7/1976 | Fed. Rep. of Germany . | |
| 1282733 | 12/1960 | France . | |
| 2556496 | 12/1983 | France . | |
| 424598 | 8/1947 | Italy | 200/149 R |

*Primary Examiner*—Henry J. Recla
*Assistant Examiner*—David J. Walczak
*Attorney, Agent, or Firm*—Pollock, VandeSande & Priddy

[57] ABSTRACT

The disclosure relates to high-voltage change-over switches that are used to apply high voltage alternately to two X-ray tubes. Each of the four switch devices constituting a change-over switch includes a fixed contact element connected to an input terminal of the high voltage and a movable contact element connected to an output terminal by a curved, flexible strip, the shifting of which is obtained by a hinged arm that is actuated by an insulator sleeve surrounding the strip. The rotation of the sleeve in one direction causes contact through a hole in the wall of the sleeve while rotation in the reverse direction causes the contact elements to move away from each other and gives rise to the interposition of the insulator wall between the contact elements at a distance. The disclosed device can be applied to radiology installations.

5 Claims, 5 Drawing Sheets

HIGH VOLTAGE SWITCH DEVICE AND HIGH-VOLTAGE CHANGE-OVER SWITCH

BACKGROUND OF THE INVENTION

1. Field of the Invention

The invention relates to high-voltage change-over switches and, more particularly, to those used to provide supplies alternately to at least two X-ray tubes from a single high-voltage generator.

X-ray tubes for medical diagnosis are generally constituted (FIG. 1) like a diode, i.e. with a cathode 11 and an anode 12 or anti-cathode, these two electrodes being enclosed in a vacuum-tight casing 14 that provides for the electrical insulation between these two electrodes. The cathode 11 emits an electron beam 13 and the anode receives the electrons on a small area that constitutes a focal spot from which the X-rays are emitted.

When the high supply voltage is applied by a generator 15 to the terminals of the cathode 11 and of the anode 12 so that the cathode is at the negative potential −HT and the anode at the potential +HT, a current known as an anode current is set up in the circuit through the generator 15 supplying the high voltage. The anode current goes through the space between the cathode and the anode in the form of the beam 13 of electrons which impinge on the focal spot.

A small proportion of the energy spent to produce the electron beam 13 is converted into X-rays, the rest of this energy being converted into heat. Hence, in view also of the high instantaneous power (in the range of 100 KW) brought into play and of the dimensions of the focal spot (in the range of one millimeter), manufacturers have long been making X-ray tubes with rotating anodes where the anode is made to rotate in order to distribute the heat flux on a ring called a focal ring, with an area far greater than that of the focus, the value of this approach increasing concomitantly with the rise in rotational speed (generally between 3,000 and 12,000 rpm).

The standard type of rotating anode has the general shape of a disk with an axis of symmetry 16 about which it is made to rotate by means of an electrical motor 17; the electrical motor has a stator 18 located outside the casing 14 and a rotor 19 mounted in the casing 14 of the X-ray tube and positioned along the axis of symmetry 16, the rotor being mechanically fixed to the anode by means of a supporting shaft 20.

2. Description of the Prior Art

The high-voltage generator 15, which gives a voltage ranging from 50 to 160 kilovolts between the −HT and +HT terminals, is a major, bulky and costly element of a radiological apparatus. Thus, in radiology installations comprising several X-ray tubes, there is provision for using only one high-voltage connector which is connected to the different X-ray tubes by means of a high-voltage change-over switch, the schematic diagram of which is given in FIG. 2 which depicts the case of a change-over switch 21 for the supply of two tubes A and B. This change-over switch 21 has two input terminals 22 and 23, respectively connected to the +HT and −HT terminals of the high-voltage generators, and two pairs of output terminals 24, 25 and 26, 27 respectively connected to the tubes A and B. The switching over is done by means of two rotary arms 28 and 29 connected on one side (contact elements 22' and 23') respectively to the input terminals 22 and 23 and, on the other side, either to the output terminals 24 and 25 (contact elements 24' and 25') for a first position of the arms (when supplying the tube A) or to the output terminals 26 and 27 (contact elements 26' and 27') for a second position of the arms (when supplying the tube B). With a mechanism such as this, it is necessary for the distances between the different contact elements to be great enough to prevent conduction by electrical arcing Thus, in dry air, the distances should be of the order of several centimeters, for example 15 centimeters for 150 kilovolts, which results in change-over switches that are large-sized and hence very bulky. Thus, to reduce this bulk, it is usual to place the change-over switch or switches in a chamber filled with insulating oil, the disruptive voltage of which is greater than 10 kilovolts per millimeter instead of one kilovolt per millimeter in dry air. This leads, naturally, to lower bulk but entails the necessity of using an oil-filled chamber.

SUMMARY OF THE INVENTION

The object of the invention, therefore, is to make a high-voltage change-over switch with reduced bulk, with or without the use of insulating oil, in implementing a potential barrier made of a material with high dielectric strength, such as a polypropylene or polyethylene type polymer, the disruptive voltage of which is equal to or greater than 80 kilovolts per millimeter.

The invention relates to a high-voltage switch device comprising a fixed contact element and a movable contact element that are positioned so as to face each other, the movable contact element being mounted at one end of an elastic curved strip that is movable longitudinally towards the fixed contact element while the other end of this strip is fixed, and means for the insulation and longitudinal shifting of the movable end of the strip so that, in a first position, the movable contact element comes into contact with the fixed contact element while, in a second position, the movable contact element is at a distance from the fixed contact element and is separated from this contact element by an insulating material.

The insulating and longitudinal shifting means comprise a sleeve, made of an insulating material, that is mounted rotationally about a fixed circular element so as to surround the flexible strip and is connected to the flexible strip by a hinged arm, the end of which is guided by a slot in said circular element, positioned in parallel to the flexible strip, so that the rotation of the sleeve in one direction shifts the movable contact element to bring it into contact with the fixed contact element in going through the wall of the sleeve by a hole in the wall, while the rotation in the reverse direction moves the movable contact element away from the fixed contact element and interposes the wall of the sleeve between the two contact elements.

A high-voltage change-over switch, used to apply or not apply a high voltage (+HT or −HT) to a power-using apparatus such as an X-ray tube comprises two switch devices described here above wherein, of its contact elements of the same type, one is connected to the +HT high voltage and the other is connected to the −HT high voltage, while the contact elements of the other type are connected to the power-using apparatus, and further comprises a device to control the rotation in synchronism of the insulating and shifting means.

A high-voltage switch to apply a high voltage (+HT, −HT) either to a first power-using device such as a first X-ray tube or a second power-using device such as a second X-ray tube comprises four switch devices, the fixed contact elements of which are connected two by two to the +HT high voltage and to the −HT high voltage and the movable contact elements of which are connected two by two to the first and second power-using devices, and further comprises a device to control the rotation in synchronism of the insulating and shifting means so as to set up, in a first position, the contact between the contact elements of the switch devices associated with the first power-using device while the contact elements of the switch devices associated with the second power-using device are open and so as to set up, in a second position, the contact between the contact elements of the switch devices associated with the second power-using device while the contact elements of the switch devices associated with the first power-using device are open.

BRIEF DESCRIPTION OF THE DRAWINGS

Other objects, features and advantages of the present invention shall appear from the following description of a particular exemplary embodiment, said description being made in relation to the appended drawings, of which.

MORE DETAILED DESCRIPTION

Figure 1:
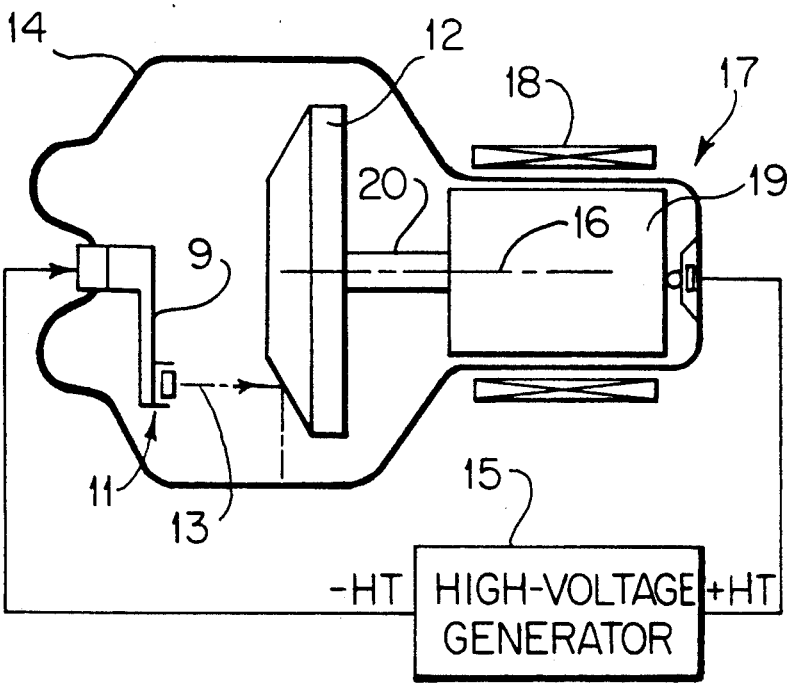
FIG. 1 is a schematic diagram of an X-ray tube with rotating anode supplied by a high-voltage generator.
Figure 2:
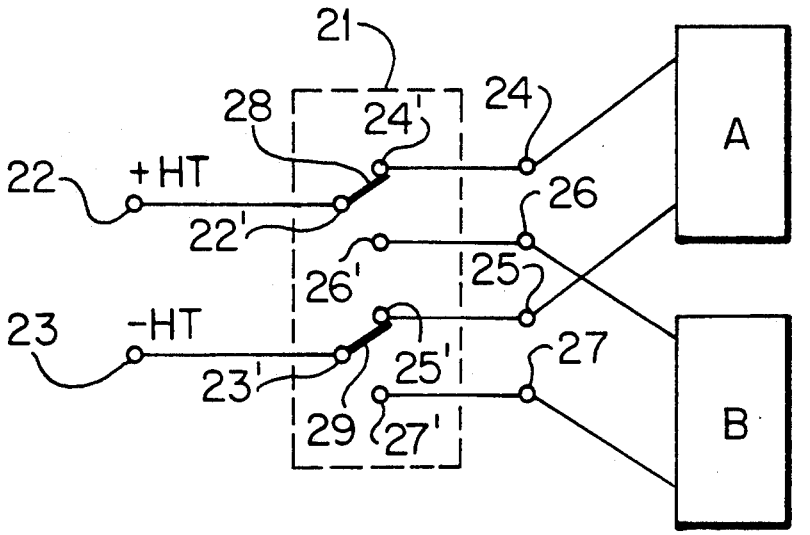
FIG. 2 PRIOR ART
FIG. 2 is a schematic diagram of a high-voltage change-over switch of the type with rotary arms according to the prior art.
Figure 3:
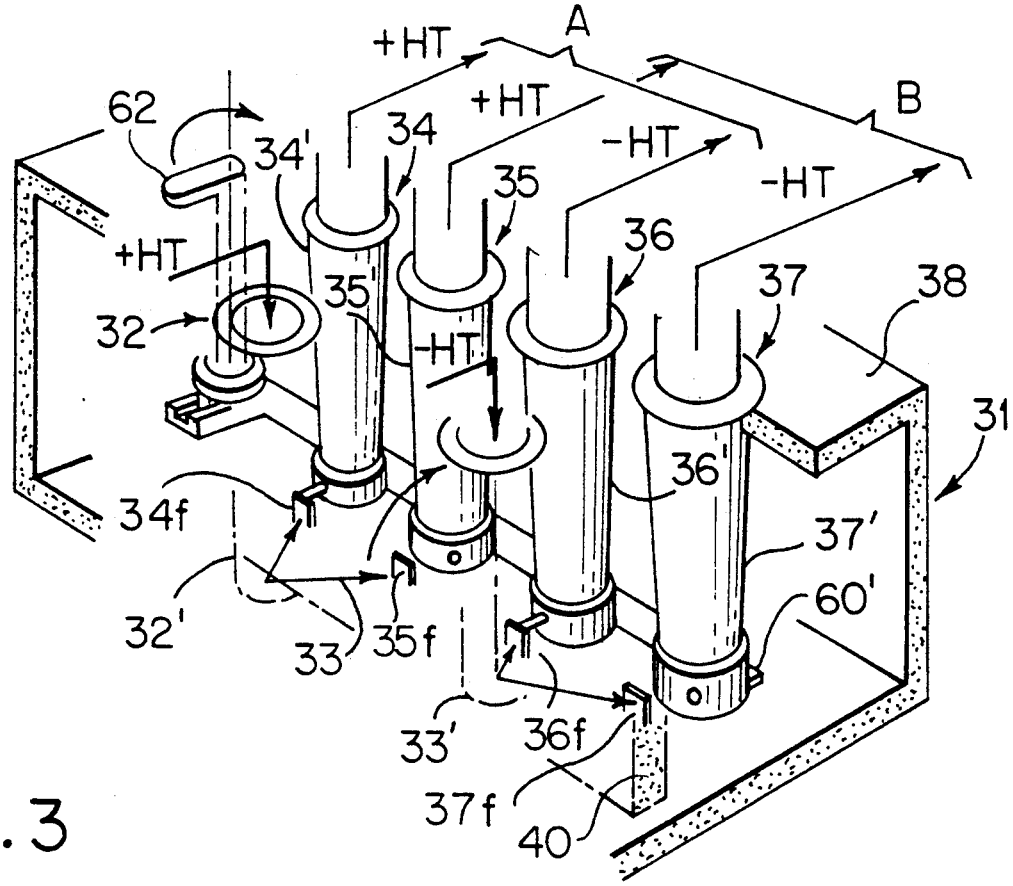
FIG. 3 is a partially cutaway view in perspective of the high-voltage change-over switch according to the invention, as mounted in its casing.
Figure 4:
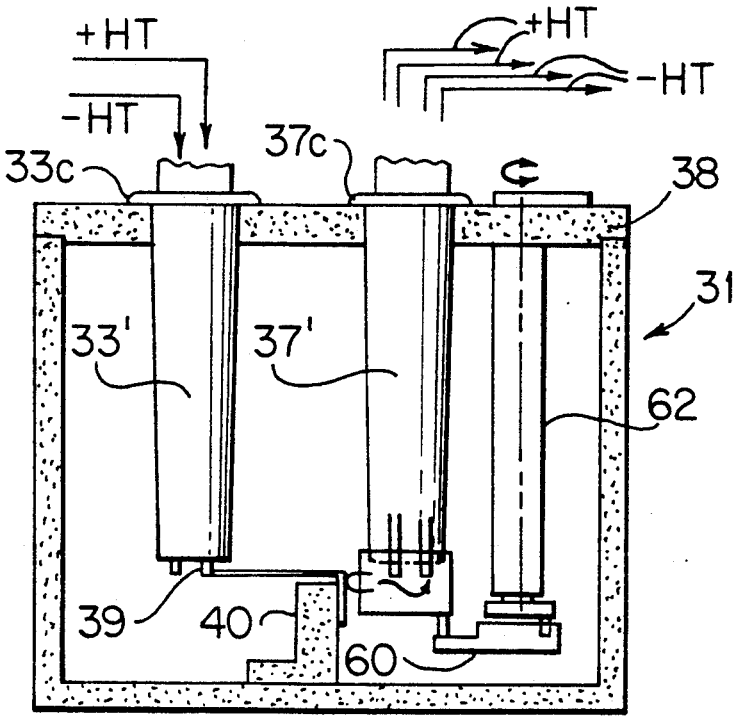
FIG. 4 is a side view of the change-over switch of FIG. 3, with the casing removed.

A change-over switch according to the invention (FIG. 3) includes a casing 31 used as a support for the different change-over elements proper and for the different electrical connectors for the input and output of the high voltage. The electrical connectors 32 to 37 comprise two input connectors 32 and 33 that are respectively connected to the two +HT and −HT poles of the high-voltage generator 15 (FIG. 1) and four output . connectors 34 to 37 that are connected to the high-voltage input terminals of the X-ray tubes A and B. In a known way, each connector is formed by a female part, shown in FIGS. 3 and 4, into which there is fitted a male part (not shown) that is connected by a cable either to the high-voltage generator or to the X-ray tubes. Each female part 32' to 37' has the shape of a circular-sectioned sleeve, made of an insulator material, comprising an open end for the fitting in of the male part and a closed end that bears electrical contact elements 39. At the level of the open part, each sleeve has an external collar, referenced 33*c* and 37*c* for the connectors 33 and 37, that leans on the edge of a circular hole made in the lid 38 of the casing 31 in such a way that the electrical contact elements are located inside the casing.

An electrical contact element 39 of the input connector 32 is connected, for example, to two fixed contact elements 34*f* and 35*f* (FIG. 7) respectively associated with the output connectors 34 and 35 while an electrical contact element 39 of the input connector 33 is connected to the other two fixed contact elements 36*f* and 37*f* (FIG. 7) respectively associated with the output connectors 36 and 37. The fixed contact elements 34*f*, 35*f*, 36*f* and 37*f* are borne by a rigid bar 40 fixedly joined to one of the walls of the casing 31.

Each fixed contact element 34*f* to 37*f* is positioned respectively so as to face a movable contact element 34*m* to 37*m* borne by a contact device 34*d* to 37*d* that is mounted on the electrical contact elements 39 of each female part 34' to 37' of an output connector 34 to 37.

Figure 5A:
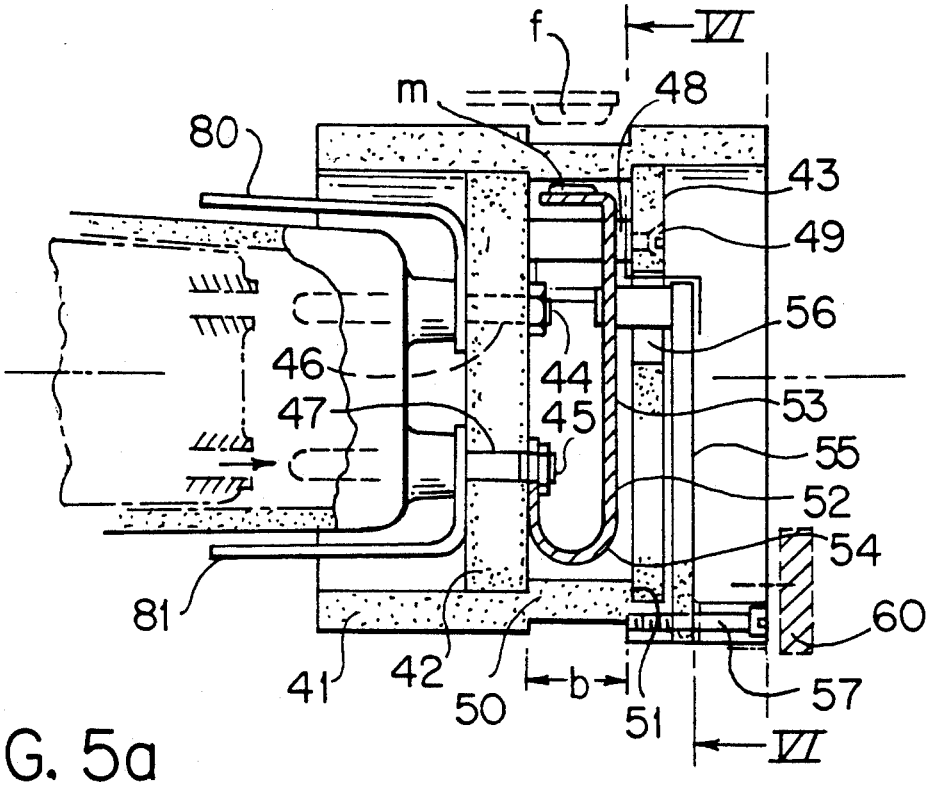
FIGS. 5-*a* and 5-*b* are sectional views showing two positions of the contact device according to the invention.
Figure 5B:
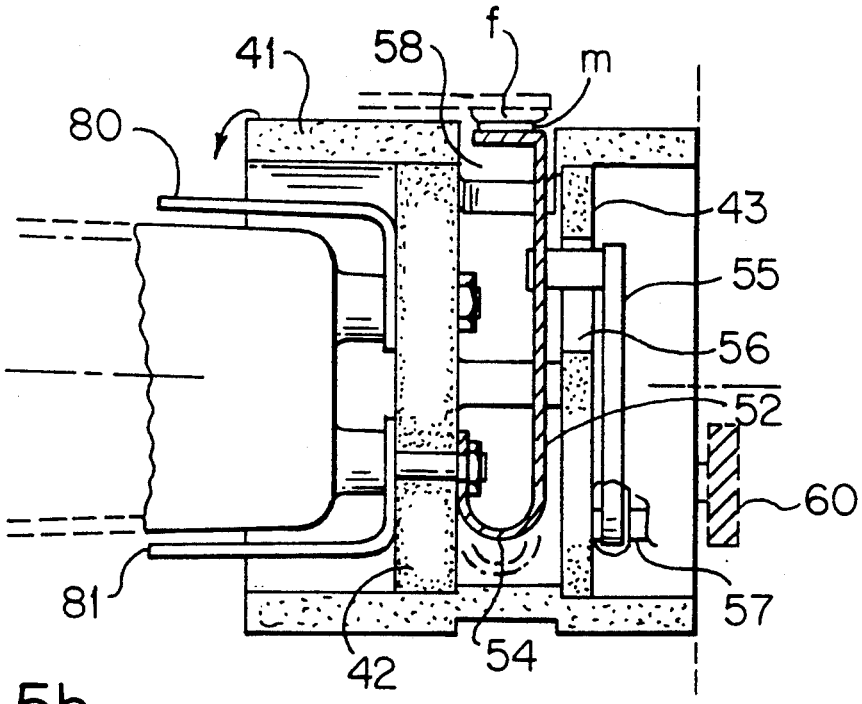
Figure 6C:
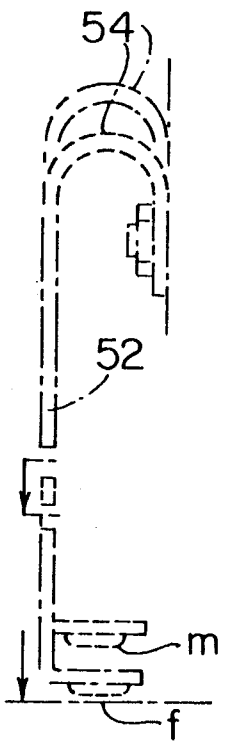
FIGS. 6-*a* and 6*b* are front views of the contact device according to the invention, corresponding respectively to FIGS. 5-*a* and 5-*b* while FIG. 6-*c* is a view showing the two positions of the contact.
Figure 6B:
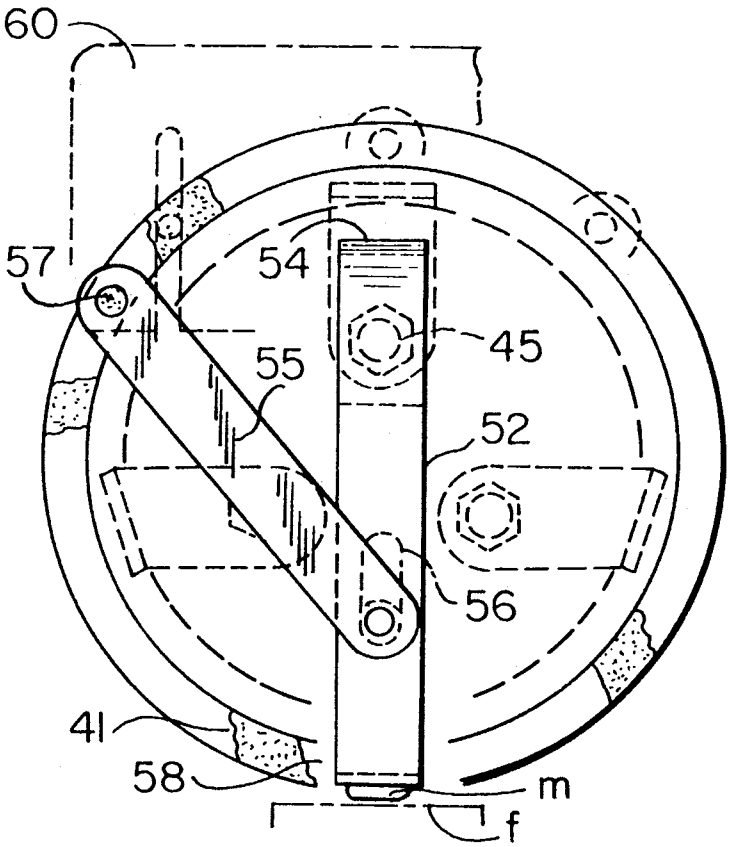
Figure 6A:
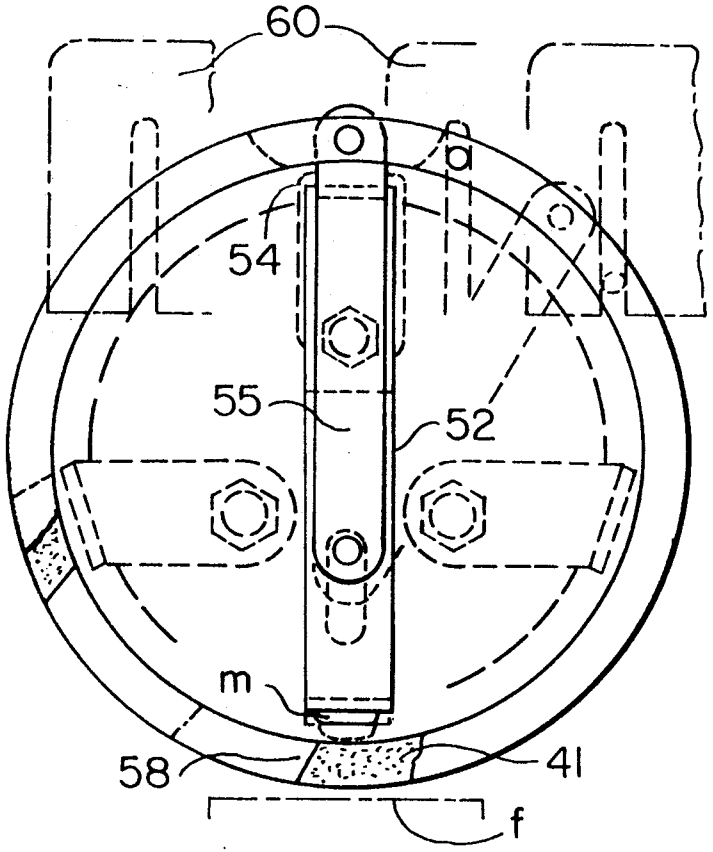
Figure 7:
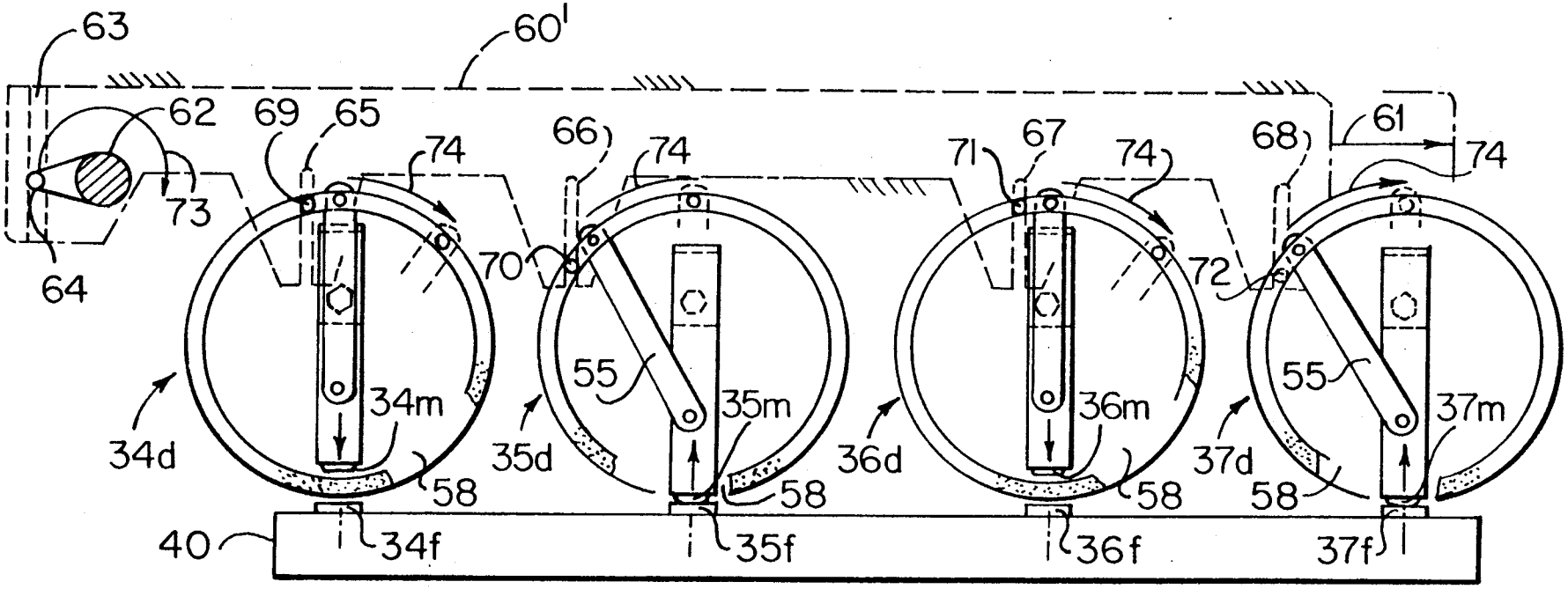
FIG. 7 is a schematic front view showing a complete change-over switch according to the invention.

As is shown in FIGS. 5, 6 and 7, each movable contact device 34*d* to 37*d* comprises a sleeve 41, made of an insulating material, with a circular cross-section, the internal wall of which has two shoulders 50 and 51 separated by a distance b against which there rest two circular pads made of an insulator material 42 and 43. The pad 42 is fixed to the female part by nuts 44 and 45 screwed on to the threaded ends of the electrical contact elements 46 and 47 respectively. The pad 43 is fixed to the pad 42 by means of spacers and screws such as those referenced 48 and 49 in FIG. 5-*a*. The length of the spacers is equal to the distance b between the shoulders 50 and 51, thus enabling the sleeve 41 to rotate about the pads 42 and 43.

The movable contact element m is positioned between the two pads 42 and 43 and is borne by a strip 52 at one end, the other end of said strip being fixed to the electrical contact element 47 which has to apply the high voltage to the tube. This strip 52, made of conductive metal, has a rectilinear part 53 that runs along the pad 42, and a curved part 54 in the vicinity of the pad that is flexible towards the movable contact element m and in the reverse direction.

The shifting of the movable contact element m is obtained by an arm 55, one end of which is fixed to the strip 52 and the other end of which is fixed to the sleeve 41. The fastening to the strip 52 is done by means of a notch 56 that is parallel to the strip so as to serve as a guide and the fastening to the sleeve 41 is done by means of a screw 57 that goes through a notch made in the wall of the sleeve.

Thus, by this assembly, when the sleeve is in the position of FIGS. 5-*a* and 6-*a*, the arm 55 is parallel to the strip 52 and moves the movable contact element m away from the fixed contact element f. On the contrary, when the sleeve has a position, different from that of FIGS. 5-*a* and 6-*a*, the arm 55 is positioned obliquely with respect to the strip 52 and shifts the movable contact element m towards the fixed contact element f.

For the movable contact element m to come into contact with the fixed contact element f, the wall of the sleeve 41 has a notch 58 at the level of the space between the two pads 42 and 43. The position of this notch 58 on the rim of the sleeve and its length are such that they enable the passage of the strip 52 so that the contact element m comes and abuts the fixed contact element f for the position of the sleeve and of the arm 55 shown in FIGS. 5-*b* and 6-*b*. In this position, the end of strip 52, on the movable contact element m side, abuts the edge of the notch, thus stopping the rotation of the sleeve 41 and, consequently, the motion of the movable contact element towards the fixed contact element.

The position of the other edge of the notch is determined by the length of the shift made by the movable contact element in its motion of withdrawal in relation to the length of the distance that diametrically separates the fixed contact element from the interior of the wall of the sleeve. When these two lengths are equal, the wall of the sleeve can get interposed between the movable contact element and the fixed contact element, and constitutes a highly efficient insulation. In the position of the movable contact element where it is furthest away from the fixed contact element (FIGS. 5-*a* and 6-*a*), the wall of the sleeve should separate the two contact elements. If the rotational motion of the sleeve is continued beyond this, the movable contact element approaches the fixed contact element and abuts the internal wall of the sleeve, and this stops its motion.

This abutting position is not desirable for the metal part of the movable contact element could get polluted, and this would be prejudicial to the obtaining of proper electrical contact between the two facing contact elements. For this reason, the rotation control device has a limited clearance to prevent the contact elements from touching the walls of the sleeves. Generally, the insertion of the insulating sleeve 41 between the contact elements should be done without friction.

FIG. 7 shows the respective position of the sleeves and of the contact elements of the change-over switch according to the invention in the case of the alternating supply of two X-ray tubes A and B as well as the position of the device for controlling the rotation of the sleeves. The contact devices 35*d* and 37*d* are shown in a closed position while the contact devices 34*d* and 36*d* are shown in an open position such that the wall of the sleeve 41 gets interposed between the two contact elements.

The device to control the rotation of the four sleeves is constituted by a rigid bar 601 made of an insulating material and designed to shift longitudinally from left to right (arrow 61) and from right to left under the effect of shaft 62, made of an insulating material, that has a rotational motion and bears, a pin 64 cooperating with a groove 63 of the bar 601. The bar 601 has grooves or notches 65 to 68 with a direction parallel to the flexible strips 52 which cooperate respectively with pins 69 to 71, respectively borne by the rim of the sleeves 34*d* to 37*d*. The rotation of the shaft 62 in the direction indicated by the arrow 73 prompts the linear shifting of the bar 61 in the direction indicated by the arrow 61. This shifting causes the rotation of the four sleeves 41 in the direction of the arrows 74 in such a way that the arms 55 take the positions indicated by the dots and dashes at the ends of the arrows 74. In this second position, the contact elements 34*m* and 36*m* respectively abut the contact elements 34*f* and 36*f* while the contact elements 35*m* and 37*m* are respectively separated from the contact elements 35*f* and 37*f* by the wall of the sleeves 41.

It will be understood that the reverse rotation of the rod 62 prompts the return of the contact devices to the positions indicated in FIG. 7.

The description just given of the high-voltage change-over switch shows that it is constituted by four high-voltage switch devices, each of which independently carries out the closing or opening of the facing contact elements, the space between the contact elements in the opening position being occupied by the insulating wall of the sleeve.

It is then possible to make a two-pole change-over switch by using two switch devices, with one switch device per pole.

As indicated in the description, all the elements, except for those participating in the electrical conduction, are made of an insulating material with high dielectrical strength. This dielectrical strength corresponds to a disruptive voltage of several tens of kilovolts per millimeter This insulating material is preferably a polymer such as a polyethylene or a polypropylene.

In FIGS. 5-*a* and 5-*b*, the elements referenced 80 and 81 are electrical conductors that are used for the electrical supply of the filament of the cathode of the X-ray tube.

What is claimed is:

1. A high-voltage switch comprising:

an insulative sleeve rotating about an axis of symmetry;

a linkage arm transversely positioned relative to the sleeve and pivotally mounted at a first end thereof to the sleeve, the first arm end describing a circle around the sleeve axis during sleeve rotation;

a conductive resilient strip diametrically positioned within the sleeve, perpendicular to the sleeve axis;

a first end of the strip being fixed to a stationary insulator pad transversely mounted within the sleeve;

means pivotally mounting a second end of the linkage arm to an intermediate point of the strip for reciprocating a free second end of the strip in response to sleeve rotation;

a fixed switch contact located outside the sleeve and in radial alignment with the strip;

a switch contact located on the second end of the strip;

an arcuate opening formed in the sleeve; and means rotating the sleeve for periodically causing switch contact closure through the opening during an interval of each sleeve rotation, the switch contacts being opened and insulated from one another by the sleeve during the remainder of each sleeve rotation, the sleeve being free of engaging either switch contact during sleeve rotation.

2. The switch set forth in claim 1 wherein all non-conductive elements of the switch are fabricated from an insulative metal having high dielectric strength.

3. The switch set forth in claim 1 wherein the sleeve is fabricated from a polymer.

4. The switch set forth in claim 3 wherein the polymer is a polyethylene or a polpropylene.

5. An assembly of high-voltage switches, each switch comprising:

an insulative sleeve rotating about an axis of symmetry;

a linkage arm transversely positioned relative to the sleeve and pivotally mounted at a first end thereof to the sleeve, the first arm end describing a circle around the sleeve axis during sleeve rotation;

a conductive resilient strip diametrically positioned within the sleeve, perpendicular to the sleeve axis;

a first end of the strip being fixed to a stationary pad transversely mounted within the sleeve;

means pivotally mounting a second end of the linkage arm to an intermediate point of the strip for reciprocating a free second end of the strip in response to sleeve rotation;

a fixed switch contact located outside the sleeve and in radial alignment with the strip;

a switch contact located on the second end of the strip;

an arcuate opening formed in the sleeve, transversely aligned with the switch contacts; and linking means mutually rotating the sleeves of the switches for synchronizing periodic contact closure through the opening of preselected switches of the assembly;

and contact opening by remaining switches of the assembly, opened contacts being insulated from one another by the sleeve which maintains a non-contacting relationship with the opened contacts.

* * * * *

UNITED STATES PATENT AND TRADEMARK OFFICE

CERTIFICATE OF CORRECTION

PATENT NO. : 5,224,592

DATED : July 6, 1993

INVENTOR(S) : Jedlitschka et al.

It is certified that error appears in the above-identified patent and that said Letters Patent is hereby corrected as shown below:

Column 2, line 7, after "arcing" insert --.--;

Column 3, line 55, delete ".";

Column 4, line 39, change "42," to --43--;

line 39, after "pad" (second occurrence), insert --42,--;

Column 4, line 54, delete ",";

Column 5, line 39, change "601" to --60'--;

line 43, delete ",";

line 44, change "601" to --60'-- (both occurrences);

line 50, change "601" to --60'--;

Column 6, line 11, after "meter" insert --.--;

line 48, change "metal" to --material--.

Signed and Sealed this

Fifteenth Day of February, 1994

*Attest:*

Bruce Lehman

BRUCE LEHMAN

*Attesting Officer*

*Commissioner of Patents and Trademarks*